US006893309B2

(12) United States Patent
Baran et al.

(10) Patent No.: US 6,893,309 B2
(45) Date of Patent: May 17, 2005

(54) APPARATUS FOR CORRECTING STATIC ELECTRON BEAM LANDING ERROR

(75) Inventors: Anthony Stanley Baran, Lancaster, PA (US); Richard William Collins, Lancaster, PA (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 13 days.

(21) Appl. No.: 10/756,575

(22) Filed: Jan. 13, 2004

(65) Prior Publication Data

US 2004/0147195 A1 Jul. 29, 2004

Related U.S. Application Data

(62) Division of application No. 09/948,754, filed on Sep. 7, 2001.

(60) Provisional application No. 60/231,853, filed on Sep. 12, 2000.

(51) Int. Cl.[7] ..... H01J 9/42

(52) U.S. Cl. ..... 445/3; 445/4; 445/30; 445/60; 445/63

(58) Field of Search ..... 445/3, 4, 63, 30, 445/66

(56) References Cited

U.S. PATENT DOCUMENTS

| | | | | | |
|---|---|---|---|---|---|
| 3,899,761 | A | | 8/1975 | Yamauchi | 355/211 |
| 4,138,628 | A | * | 2/1979 | Smith | 315/368.27 |
| 4,232,283 | A | | 11/1980 | Werst | 355/212 |
| 4,453,921 | A | | 6/1984 | Venturi | 445/23 |
| 4,786,973 | A | | 11/1988 | Lock et al. | 348/830 |
| 4,894,711 | A | | 1/1990 | Barten | 348/812 |
| 5,191,253 | A | | 3/1993 | Kang | 313/440 |
| 5,223,769 | A | | 6/1993 | Priere et al. | 315/370 |
| 5,227,753 | A | | 7/1993 | Hirai et al. | 335/212 |
| 5,347,367 | A | | 9/1994 | Swank et al. | 348/822 |
| 5,485,054 | A | | 1/1996 | Van Kemenade et al. | 313/440 |
| 5,621,287 | A | | 4/1997 | Dossot et al. | 315/399 |
| 5,635,719 | A | | 6/1997 | Petric | 250/396 ML |
| 5,869,923 | A | | 2/1999 | Strzelichowski et al. | 313/440 |
| 6,005,340 | A | | 12/1999 | Misono et al. | 313/443 |
| 6,069,438 | A | | 5/2000 | Okamoto | 313/442 |
| 6,504,295 | B1 | | 1/2003 | Chang | 313/440 |

* cited by examiner

*Primary Examiner*—Joseph Williams
(74) *Attorney, Agent, or Firm*—Joseph S. Tripoli; Harvey D. Fried; Sammy S. Henig

(57) ABSTRACT

A seamless magnetic sheath is mounted on a funnel of a cathode ray tube, behind the deflection windings of a deflection yoke. Various combinations of magnetic poles are formed in the sheath magnetic ferrite material for varying the beam landing location of the screen of a cathode ray tube. The seamless magnetic sheath is formed by an extrusion or a molding fabrication process.

5 Claims, 4 Drawing Sheets

APPARATUS FOR CORRECTING STATIC ELECTRON BEAM LANDING ERROR

CROSS REFERENCE TO RELATED APPLICATIONS

This application claims priority of U.S. Provisional Application 60/231,853 filed Sep. 12, 2000. This application is a divisional of Ser. No. 09/948,754 file Sep. 7, 2001.

The invention relates to an arrangement for correcting a static beam landing error in a cathode ray tube (CRT) and to a method of manufacturing the same.

BACKGROUND OF THE INVENTION

It is known to mount a sleeve-that contains a magnetic material such as ferrite onto a neck of A CRT for correcting static convergence, color purity and geometry errors in the CRT. A manufacturer of the ferrite magnetic material either extrudes a heated magnetic material through a rectangular slit die or rolls the material into sheets. In both cases, long coils of belt-like sheath material are provided to the CRT manufacturer. The sheets are cut into strips. The edges of a given strip are spliced, using a securing tape, to form a spliced cylindrical shape that is mounted on a funnel of the CRT to form a sleeve or sheath.

Beam landing correction is accomplished by the creation of various combinations of magnetic poles in the ferrite material that produce static or permanent magnetic fields. The magnetic fields vary the beam landing location in the CRT. The magnetic pipe sheath is referred to as a sheath beam bender (SBB). The SBB can correct for mount seal rotation in the CRT.

A magnetizer head is used at the factory for magnetizing the SBB. The SBB is used to create two, four and six pole vertical and horizontal corrections to the electron beams at different planes perpendicular to the electron beam path. For example, two plane correction is called Blue Bow and is a result of a pair of four pole vertical corrections.

A SBB, embodying an inventive feature, is formed from a seamless magnetic sheath, for example, by extrusion by using an extrusion die. Alternatively, a high pressure injection mold may be used for producing an injection molded seamless SBB. Advantageously, the seamless nature of the sheath eliminates tape bumps and rough splice joints associated with prior art arrangements. Thereby, advantageously, closer contact between the magnetizer head that is used at the factory and the SBB is facilitated. Advantageously, the use of the seamless pipe sheath eliminates SBB gap. It eliminates SBB edge-to-edge misalignment, thus improving Yoke Adjustment Machine (YAM) yield. It eliminates an overlap splice hump that restricts magnetizer head closure causing magnetizer error rejects. Cost reduction is obtained by the elimination of the need for using a securing tape. Advantageously, it is readily adaptable to robotic application. Cost reduction also results from the ability to recycle pipe sheaths on product that is set up more than once. Advantageously, the need to position the gap of the sheath, occurring with some prior art arrangements, is no longer of concern because the sheath material is seamless.

A deflection yoke mounted on the CRT may include an auxiliary Beam Scan Velocity Modulation (BSVM) coil. On a very larger size (VLS) CRT, where the deflection yoke is mechanically attached to the funnel of the CRT, a prior art SBB is typically taped directly onto the funnel using two pieces of Mylar tape. Afterwards, a wire-wound BSVM coil, placed on a plastic carrier, is mechanically attached over the top of the SBB.

In carrying out a further inventive feature, by using, for example, the injection mold technique, an integrated SBB/BSVM combination device having seamless SBB is obtained. The integrated SBB/BSVM combination device having seamless SBB that is formed by injection mold technique can utilize solid conductor wire wound BSVM molded into sheath material. Such arrangement may be, advantageously, less costly. Also, this permits placing the BSVM coil closer to the electron gun. Thereby, advantageously, the BSVM sensitivity is improved by eliminating the thickness of a prior art plastic carrier.

SUMMARY OF THE INVENTION

A deflection apparatus for correcting an electron beam landing error, includes a cathode ray tube having a funnel to form a path for an electron beam. A deflection winding is provided for producing scanning of the electron beam on a screen of the cathode ray tube. A seamless sheath of magnetic material is mounted to encircle the funnel for producing a first pole of magnetic field in a first plane and a second pole of magnetic field in a second plane separated from first plane along a longitudinal axis of the cathode ray tube.

DETAILED DESCRIPTION OF THE DRAWINGS

FIG. 1 illustrates a seamless hollow pipe sheath formed by an extrusion process;

FIG. 2*a* illustrates a seamless sheath beam bender (SBB), embodying an inventive feature, made from the pipe of FIG. 1;

FIG. 2*b* illustrates in a partially assembled state an integrated combination device that includes the seamless SBB of FIG. 2*a;*

FIG. 2*c* illustrates a completely assembled integrated SBB/BSVM combination device of FIG. 2*b;*

DETAILED DESCRIPTION OF THE PREFERRED EMBODIMENTS

Figure 1:
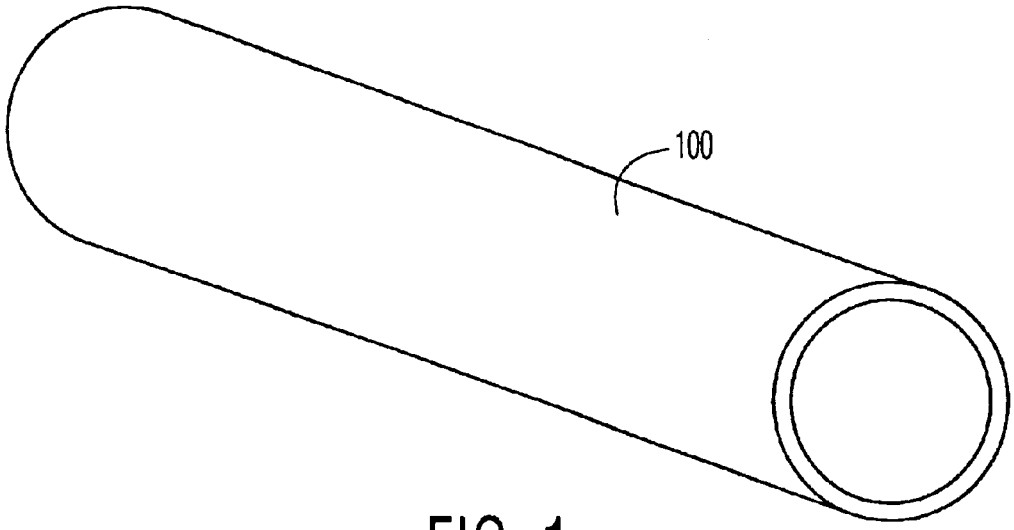
Figure 2A:
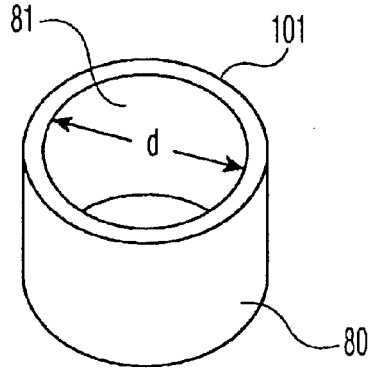

FIG. 1 illustrates a seamless hollow pipe sheath 100 that is used for producing a pipe shaped seamless sheath beam bender (SBB) 101 of FIG. 2*a*, embodying an inventive feature. Pipe sheath 100 of FIG. 1 can be formed in an extrusion die, not shown, by an extrusion process in a similar manner to the extrusion of a plastic pipe. However, instead of a plastic material, a mixture of ferrous material and flexible binder such as barium ferrite or strontium ferrite mixed with a butyl rubber carrier (Hyplon & Vixtex) is formed. The materials in the mixture are calendared, shredded and extruded at high temperature and pressure. The mixture, pelletized and heated to a high temperature, is forced through an extrusion die, not shown, for producing seamless hollow pipe sheath 100, in a similar manner toothpaste is dispensed from a collapsible tube. Seamless hollow pipe sheath 100 has a suitable wall thickness, such as, for example, between 0.075 inch to 0.118 inch, to retain magnetization upon placement in a strong, localized, magnetic fields. Seamless pipe sheath 100 having a length of, for example, 25 inch is rapidly cooled in liquid and later cut into cylindrical seamless pipe sheath pieces such as seamless SBB 101 of FIG. 2*a* having a length of, for example, one inch.

Figure 3:
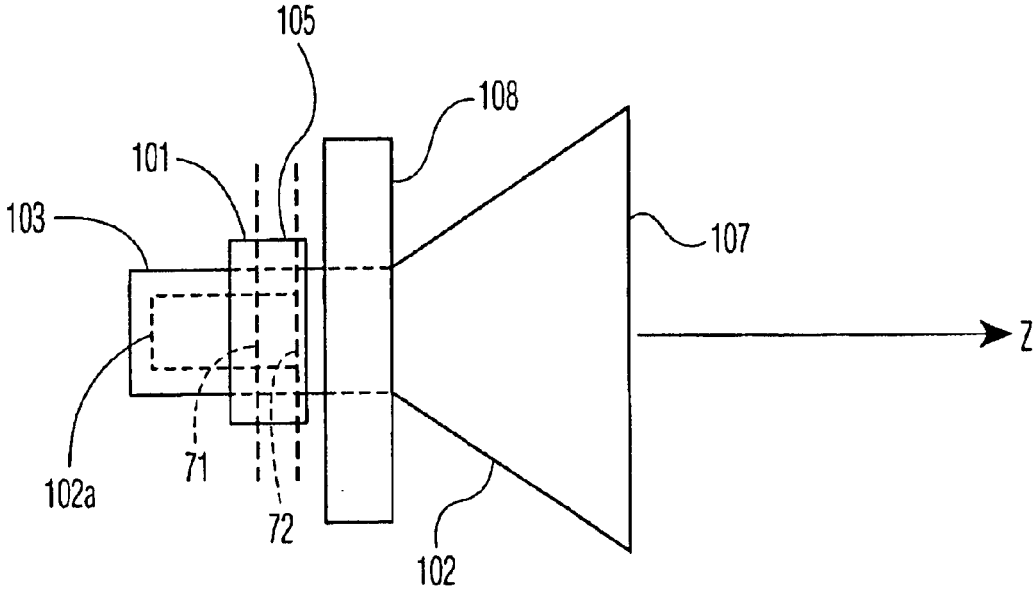
FIG. 3 illustrates the seamless SBB of FIG. 2*a*, as mounted on a funnel of a cathode ray tube.

Seamless SBB 101 is placed onto a funnel 103 of a cathode ray tube (CRT) 102 of FIG. 3. Seamless SBB 101 is placed behind a deflection winding assembly or yoke 108 after deflection yoke 108 is mounted on funnel 103. Similar symbols and numerals in FIGS. 2*a* and 3 indicate similar items or functions. Deflection yoke 108 of FIG. 3 produces scanning of the electron beam on a screen 107 of CRT 102 in a vertical and in a horizontal direction.

A magnetizer head, not shown, is placed in the factory close to an exterior surface 80 of seamless SBB 101 of FIG. 2*a* to create two, four and six magnetic pole groups. The various combinations of magnetic poles in the ferrite material of seamless SBB 101 vary the beam landing location of CRT 102, in a well known manner to provide vertical and horizontal corrections to the electron beams, not shown, of CRT 102 of FIG. 3. For example, a first group of magnetic poles, not shown, is formed in a plane 71 and a second group of magnetic poles, not shown, is formed in a plane 72. Planes 71 and 72 are separated from each other along a longitudinal axis Z of CRT 102.

Securing seamless SBB 101 to CRT 102 of FIG. 3 is achieved by heating seamless SBB 101 to a sufficiently high expansion temperature, causing seamless SBB 101 to expand for easy placement on funnel 103 of CRT 102. An expansion temperature selected from a range of temperatures between 100° C. and 130° C. was found to be preferable. Thereafter, seamless SBB 101 is contracted by cooling.

Figure 4:
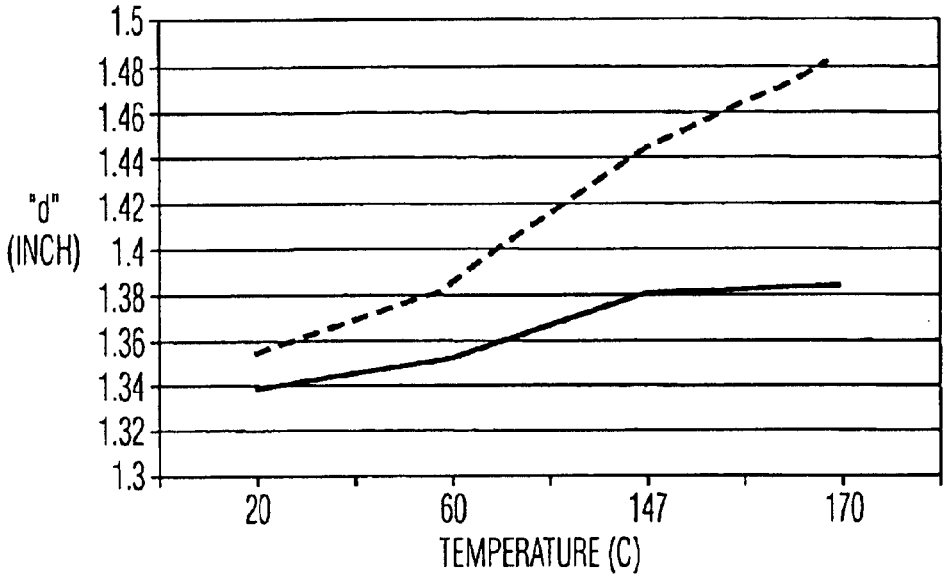
FIG. 4 illustrates, in a graph form, the amount of stretching tolerated by seamless SBB of FIG. 2*a*.

Tests were performed to determine the extent to which seamless SBB 101 could be stretched for securing it to funnel 103 of FIG. 3 without the need for tape or glue. The graph of FIG. 4 illustrates in a solid line the amount of expansion of an inner diameter "d" of SBB 101 of FIG. 2*a* as a function of temperature, when no mechanical stretching force is applied. The graph of FIG. 4 illustrates in a broken line the maximum amount of expansion of inner diameter "d" of SBB 101 of FIG. 2*a* as a function of temperature that can be obtained by applying a mechanical stretching force. It was found that SBB 101 of FIG. 2*c* could safely be heated to approximately 140° C. without damage. No glue, adhesive, or tape was added to secure seamless SBB 101 to funnel 103.

The area of funnel 103 over which seamless pipe piece 101 is to be located can optionally be coated with a rubberized cement, for example, Ply-O-bond or 2141 glue. Thereby, locking improvement of seamless SBB 101 onto funnel 103 is obtained, after seamless SBB 101 has contracted by cooling. Recycled product would simply require re-heating seamless SBB 101 to the expansion temperature 130° C. followed by removing seamless SBB 101.

Alternatively, during the extrusion process, the material can be "frozen" in a larger than normal state. Consequently, when seamless SBB 101 is placed on CRT funnel 103, localized heat is applied to seamless SBB 101. Therefore, seamless SBB 101 shrinks to its normal (smaller) diameter locking it onto funnel 103. In this alternative, recycled product would require replacement of old seamless SBB 101 with a pre-expanded seamless SBB 101. These attachment techniques are referred to as heating/cooling techniques.

Instead of using the heating/cooling techniques, SBB 101 can be attached by an adhesive tape directly onto funnel 103 of FIG. 3. Another securing method utilizes slitting the pipe of SBB 101, in a manner not shown, along the Z axis at several locations and then securing SBB 101 with a plastic clamp, not shown. All of these securing methods permit easy removal of SBB 101 for recycled product.

Figure 2B:
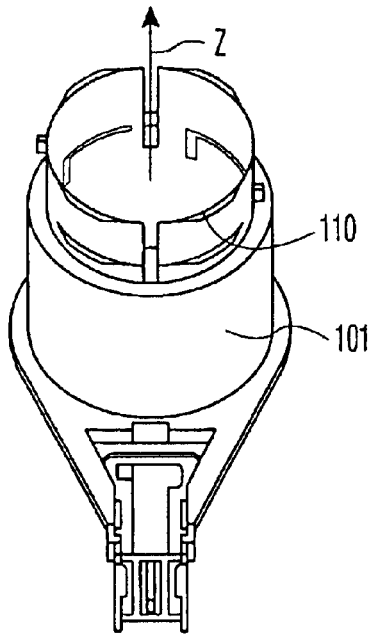
Figure 2C:
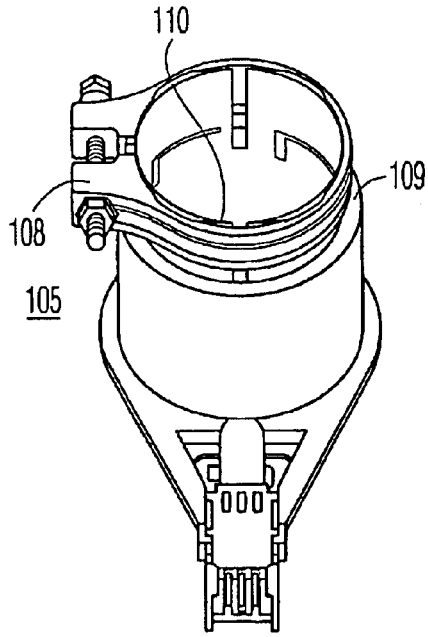

Seamless SBB 101 of FIG. 2*a* can be placed around a ring shaped plastic carrier 110 of FIG. 2*b*. An auxiliary Beam Scan Velocity Modulation (BSVM) coil 109 of FIG. 2*c* is placed around ring shaped plastic carrier 110 to form an integrated SBB/BSVM combination device 105. Similar symbols and numerals in FIGS. 2*a*, 2*b*, 2*c* and 3 indicate similar items or functions.

As shown in FIG. 2*b*, plastic carrier 110 is slit along a Z axis at several locations. Seamless SBB 101 of FIG. 2*a* can be cut or notched, in a manner not shown, to prevent rotation when placed onto integrated SBB/BSVM unit 105 of FIG. 2*c*. One such technique is to make alternate angular cuts, not shown, of the pipe of SBB 101 to key it to plastic carrier 110. Another technique is to attach SBB 101 of FIG. 2*c* to plastic carrier 110 and to BSVM coil 109 using one of the aforementioned heating/cooling techniques. Seamless SBB 101 can simply be heated to 130° C. and then forced onto carrier 110.

Integrated SBB/BSVM combination device 105 of FIG. 2*c* is mounted as a complete unit on funnel 103 of FIG. 3. Plastic carrier 110 is then secured with a plastic clamp 108 of FIG. 2*c*.

A test was performed both with BSVM coil 109 mounted on carrier 110 and without BSVM coil 109. As a result, SBB 101 resistance to rotation was found to be comparable to that achieved with a non-seamless strip sheath, not shown, attached with a tape.

The maximum stored magnetic field strength or energy for seamless SBB 101 with 0.118" thick walls was found to be comparable to that of a non-seamless 0.118" strip sheath. In both seamless SBB 101 with 0.118" thick walls and non-seamless 0.118" strip sheath the average stored magnetic field strength or energy before thermal cycling was 56.4 Gauss and after thermal cycling it was 54.6 Gauss.

Figure 5:
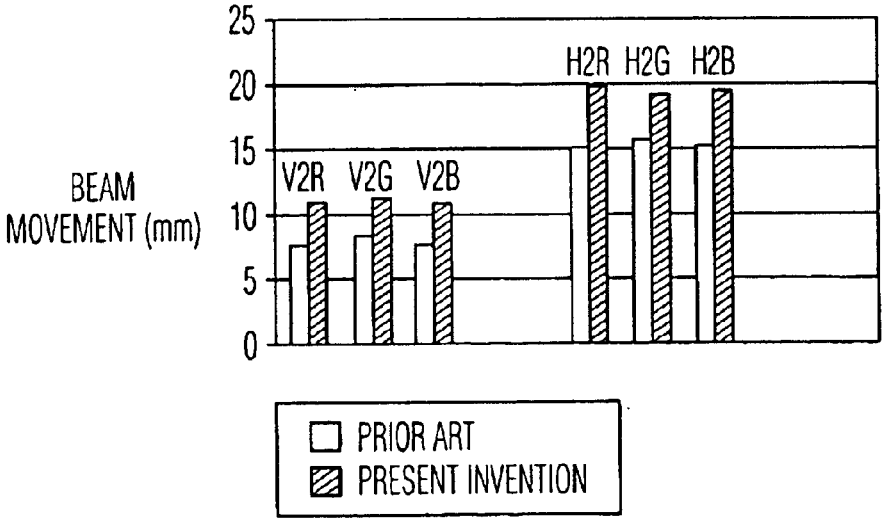
FIG. 5 illustrates, in a graph form, the maximum beam landing location displacement obtained in the seamless SBB of FIG. 2*a* relative to that in a prior art non seamless SBB.

SBB 101 of FIG. 2*a* was placed on a W86 (VLS CRT) and a measurement of a maximum static displacement of the electron beam landing location on a CRT screen 107 of FIG. 3 was made. The measurement was made with a pair of magnetic poles, not shown, disposed in, for example, plane 71. The measurement was repeated on the same yoke/tube combination using a non-seamless SBB. The graph of FIG. 5 illustrates in a solid bar the maximum static vertical displacement, V2R, V2G and V2B, of red, green and red horizontal lines, respectively, on a screen 107 of CRT 102 of FIG. 3, when seamless SBB 101 of FIG. 2*a* is utilized. For comparison purposes, the graph of FIG. 5 also illustrates in a non-solid bar the maximum static vertical displacement, V2R, V2G and V2B, of red, green and red horizontal lines, respectively, on CRT screen 107 of FIG. 3, when a non-seamless SBB, not shown, is utilized.

The measurement was also made with a pair of magnetic poles, not shown, of seamless SBB 101 of FIG. 2*a*, disposed in, for example, plane 72. The measurement was repeated on the same yoke/tube combination using a non-seamless SBB. The graph of FIG. 5 illustrates in a solid bar the maximum static horizontal displacement, H2R, H2G and H2B, of red, green and red vertical lines, respectively, on CRT screen 107, when seamless SBB 101 is utilized. The graph of FIG. 5 illustrates in a solid bar the maximum static horizontal displacement, H2R, H2G and H2B, of red, green and red vertical lines, respectively, on CRT screen 107, when non seamless SBB is utilized.

As shown in FIG. 5, seamless SBB 101 of FIG. 2*a* has, advantageously, a larger maximum static displacement of the electron beam landing location on CRT screen 107 of FIG. 3 than the non-seamless SBB. Seamless SBB 101 of FIG. 2*a* has no gap or irregularity caused by a securing tape that is used in a non seamless SBB, not shown. Therefore, a magnetizer head, not shown, can fit, advantageously, closer to the surface of SBB 101. The result is that greater coupling to the magnetizer head, not shown, is obtained to produce greater magnetic pole strengths. Since the maximum stored energy of the non-seamless SBB, not shown, and seamless SBB 101 are nearly identical, it is believed that the improved performance of seamless SBB 101 was obtained due to the closer coupling of a magnetizer head, not shown.

In carrying out another aspect of the invention, instead of the extrusion die, referred to above, a high pressure injection mold, not shown, can be utilized to 1o produce a seamless integrated SBB/BSVM combination device that is similar to integrated SBB/BSVM combination device 105 of FIG. 3*c*, with the differences noted. A wire form BSVM coil, not shown, (with an optional connector) can be loaded into an injection die, not shown, at the beginning of each injection cycle. The BSVM coil, not shown, can be placed into the ferrite sheath mixture, on an underside surface 81 of FIG. 2*a* of the sheath and closer to an electron gun 102*a* of CRT 102 of FIG. 3, thus improving BSVM performance. A securing clamp, not shown, can be made integral with the sheath SBB and can be molded from the same sheath material to form an integrated SBB/BSVM combination device, not shown. Experiments of mixing strontium ferrite with different molding materials (i.e. CONAP TU901, TU971, CU23, CN21 at different proportions of strontium ferrite) have demonstrated the feasibility of this method. The assembly merely requires the addition of a securing bolt, not shown, for clamping to funnel 103 of CRT 102.

What is claimed is:

1. A method for assembling a deflection apparatus, comprising:

providing a cathode ray tube having a funnel to form a path for an electron beam;

providing a deflection winding for producing scanning of said electron beam on a screen of said cathode ray tube; and providing a seamless sheath of magnetic material for producing a first pole of magnetic field in a first plane and a second pole of magnetic field in a second plane separated from said first plane along a longitudinal axis of said cathode ray tube, wherein said seamless sheath of magnetic material is mounted to encircle said funnel using at least one of a heating technique and cooling technique.

2. A method for assembling a deflection apparatus, comprising:

providing a cathode ray tube having a funnel to form a path for an electron beam;

providing a seamless sheath of magnetic material; and mounting said seamless sheath to encircle said funnel using at least one of a heating technique and cooling technique.

3. The method for assembling a deflection apparatus according to claim 2, wherein said sheath is heated to cause an expansion of said sheath, then said sheath is installed to encircle said funnel and then said sheath is cooled that causes said sheath to contract.

4. The method for assembling a deflection apparatus according to claim 3, wherein, when said sheath contracts, said sheath applies a force to said funnel.

5. The method for assembling a deflection apparatus according to claim 2 further comprising the step of providing a carrier or an integrated combination device that includes an auxiliary Beam Scan Velocity Modulation (BSVM) coil, wherein said seamless sheath is mounted on said carrier using said at least one of the heating technique and cooling technique to secure a position of said sheath on said carrier.

* * * * *